US010661314B2

(12) United States Patent
Birkin et al.

(10) Patent No.: US 10,661,314 B2
(45) Date of Patent: May 26, 2020

(54) CLEANING APPARATUS AND METHOD USING AN ACOUSTIC TRANSDUCER

(71) Applicant: SLOAN WATER TECHNOLOGY LIMITED, London (GB)

(72) Inventors: Peter Robert Birkin, Southampton (GB); Timothy Grant Leighton, Southampton (GB); Douglas G. Offin, Southampton (GB)

(73) Assignee: SLOAN WATER TECHNOLOGY LIMITED, London (GB)

( * ) Notice: Subject to any disclaimer, the term of this patent is extended or adjusted under 35 U.S.C. 154(b) by 120 days.

(21) Appl. No.: 15/573,653

(22) PCT Filed: May 13, 2016

(86) PCT No.: PCT/EP2016/060911

§ 371 (c)(1),
(2) Date: Nov. 13, 2017

(87) PCT Pub. No.: WO2016/180978

PCT Pub. Date: Nov. 17, 2016

(65) Prior Publication Data

US 2018/0147610 A1 May 31, 2018

(30) Foreign Application Priority Data

May 13, 2015 (GB) ..... 1508167.2

(51) Int. Cl.
*B08B 3/12* (2006.01)
*A47L 11/40* (2006.01)
(Continued)

(52) U.S. Cl.
CPC ..... *B08B 3/12* (2013.01); *A47L 11/405* (2013.01); *B08B 7/028* (2013.01); *G10K 11/30* (2013.01); *A47L 2601/17* (2013.01)

(58) Field of Classification Search
CPC ..... B08B 3/12
See application file for complete search history.

(56) References Cited

U.S. PATENT DOCUMENTS

| | | | | |
|---|---|---|---|---|
| 4,103,519 | A | 8/1978 | Davidson | |
| 2003/0106566 | A1* | 6/2003 | Danese | B08B 3/12 134/1.3 |
| 2008/0209650 | A1* | 9/2008 | Brewer | A46B 15/0002 15/22.1 |

FOREIGN PATENT DOCUMENTS

DE 4111592 A1 10/1992

OTHER PUBLICATIONS

Int'l. Preliminary Report on Patentability dated Nov. 14, 2017 in priority application PCT/EP2016/060911.

(Continued)

*Primary Examiner* — Jason Y Ko
(74) *Attorney, Agent, or Firm* — Banner & Witcoff, Ltd.

(57) ABSTRACT

An apparatus and method for cleaning a surface, the apparatus comprising: a body defining a cavity, the body terminating in a distal end that is adapted, in use, to be in the vicinity of a surface to be cleaned such that the surface to be cleaned forms an end wall of a chamber including the cavity; at least one cleaning liquid inlet for flow of a cleaning liquid into the chamber; a divider located in or at the end of the cavity that divides the chamber into a first portion and a second portion, the second portion, in use, being in fluid communication with the surface to be cleaned; and an acoustic transducer associated with the first portion of the chamber to introduce acoustic energy into the chamber; wherein the divider is adapted to permit the passage of acoustic energy therethrough from the first portion of the chamber to the second portion of the chamber to thereby allow pressure fluctuations to be generated at the surface to be cleaned.

19 Claims, 5 Drawing Sheets

(51) Int. Cl.
*B08B 7/02* (2006.01)
*G10K 11/30* (2006.01)

(56) References Cited

OTHER PUBLICATIONS

Int'l. Search Report and Written Opinion dated Oct. 17, 2016 in priority appliction PCT/EP2016/060911.
Search Report under Section 17 dated Aug. 20, 2015 in priority application GB1508167.2.

* cited by examiner

CLEANING APPARATUS AND METHOD USING AN ACOUSTIC TRANSDUCER

FIELD OF THE INVENTION

The present invention relates to a cleaning apparatus and to a method of cleaning a surface.

BACKGROUND OF THE INVENTION

Many surfaces, including floors, walls, ceilings, vehicle surfaces and other panels, need to be cleaned periodically. Known surface cleaning apparatuses and methods often provide unsatisfactory cleaning performance and leave large quantities of cleaning liquid on the surface being cleaned and in the surrounding area. Known surface cleaning apparatuses and methods are also often inefficient, using large amounts of cleaning liquid and energy. Known surface cleaning apparatuses and methods are also often less effective than required at cleaning crevices, cracks and pores within otherwise flat surfaces.

Ultrasonic cleaning is used in some industries to clean objects. Objects to be cleaned by ultrasonic cleaning are generally placed in an ultrasonic bath filled with a cleaning liquid and exposed to ultrasound to effect cleaning. However, conventional ultrasonic cleaning apparatuses are not suitable for cleaning many types of surfaces, including floors, walls, ceilings, vehicle surfaces and other panels, and, in any case, often suffer from the above-mentioned disadvantages.

The present invention provides a cleaning apparatus and a method of cleaning a surface that addresses the above-mentioned disadvantages.

SUMMARY OF THE INVENTION

A first aspect of the invention provides an apparatus for cleaning a surface, the apparatus comprising: a body defining a cavity, the body terminating in a distal end that is adapted, in use, to be in the vicinity of a surface to be cleaned such that the surface to be cleaned forms an end wall of a chamber including the cavity; at least one cleaning liquid inlet for flow of a cleaning liquid into the chamber; a divider located in or at the end of the cavity that divides the chamber into a first portion and a second portion, the second portion, in use, being in fluid communication with the surface to be cleaned; and an acoustic transducer associated with the first portion of the chamber to introduce acoustic energy into the chamber; wherein the divider is adapted to permit the passage of acoustic energy therethrough from the first portion of the chamber to the second portion of the chamber to thereby allow pressure fluctuations to be generated at the surface to be cleaned.

The distal end of the body is the end of the body that is, in use, arranged closest to the surface to be cleaned.

The apparatus of the first aspect of the invention allows acoustic energy to be delivered to a surface to be cleaned to provide effective and efficient cleaning of the surface, especially by activating gas bubbles at or near to the surface to be cleaned to effect cleaning. The activation of gas bubbles preferably comprises using the acoustic energy to cause non-inertial motion of gas bubbles at the surface to be cleaned. Non-inertial motion of gas bubbles may also be generated at a distance from the surface to be cleaned. The activation of gas bubbles may further comprise using the acoustic energy to cause inertial cavitation of the gas bubbles at the surface to be cleaned and/or at a distance from the surface to be cleaned, depending on the pressure amplitude generated by the apparatus. Inertial cavitation at the surface to be cleaned allows particularly effective cleaning for robust surfaces, but may be avoided in some applications, especially when cleaning more delicate surfaces.

The second portion of the chamber may be partially or wholly located outside the cavity provided in the body, or alternatively largely (or even wholly) located within the cavity provided in the body. For example, in embodiments in which the divider is located at or over the distal end of the body (as discussed below), the second portion of the chamber may be wholly outside the cavity provided in the body. In other embodiments in which the divider is stepped back from the distal end of the body and the distal end of the body is spaced apart from the surface to be cleaned in use, at least a part of the second portion of the chamber may be located within the cavity provided in the body, with the remainder being located between the distal end of the body and the surface to be cleaned. In other embodiments in which the divider is stepped back from the distal end of the body and the distal end of the body lies directly on the surface to be cleaned in use, substantially all of the second portion of the chamber may be located within the cavity in the body. In this case the volume of the chamber is substantially the same as the volume of the cavity.

It should be noted that, although the distal end of the body is generally spaced apart from the surface to be cleaned in use, either with or without a skirt extending between the body and the surface to be cleaned, in some embodiments the distal end of the chamber itself is arranged to directly engage the surface to be cleaned in use.

The acoustic transducer may be operable to, in use, generate acoustic resonance within the chamber when the apparatus is positioned on or adjacent to a surface to be cleaned with the surface to be cleaned forming an end wall of the chamber, an acoustic pressure antinode being formed at or adjacent to the surface to be cleaned. The formation of an acoustic pressure antinode at or adjacent to the surface to be cleaned allows efficient energy transfer from the acoustic transmitter to the surface to be cleaned, thereby minimising the power requirements of the cleaning apparatus and minimising transducer heating. An acoustic pressure antinode may be generated at the surface to be cleaned when the surface to be cleaned acts as an acoustically rigid boundary or an approximately acoustically rigid boundary such that it reflects acoustic pressure waves substantially without a change in phase. Examples of suitable surfaces for cleaning with the apparatus include concrete, metals, plastics and ceramics.

The body (and chamber) may, for example, be in the form of a circular, oval, triangular, square, rectangular, pentagonal, hexagonal etc. cylinder or prism. The cylinder or prism may have any number of sides.

The cross-section of the body and/or the cavity may be constant along a length of the body (in a direction perpendicular to the surface to be cleaned in use), or alternatively may vary along the length of the body. The body (and chamber) may, for example, be in the form of a truncated cone, or a truncated pyramid, or a straight or curved horn, or a hemisphere, or another form of dome. Other shapes are possible.

The body (and chamber) may have a diameter or lateral width (in a direction parallel to the surface to be cleaned in use) in the range of 5 mm to 1 m, or 10 mm to 150 mm, or 20 mm to 100 mm Other dimensions are possible.

The chamber may have and a length (in a direction perpendicular to the surface to be cleaned in use) in the range of 10 mm to 140 mm, or 20 mm to 120 mm, or 60 mm to 100 mm Other dimensions are possible. In one particular preferred embodiment the length is 100 mm. It should be noted that the length of the body may be less than the length of the chamber in embodiments in which a skirt extends outwardly from the distal end of the body.

The body may be formed of, for example, a metal or a polymeric material such as an acrylic material.

In one preferred embodiment of the present invention, the body has a rectangular or square cross-section and be formed of a polymeric material.

In preferred embodiments of the present invention, the body has a regular external shape, for example having a rectangular or square cross-section, or any other prismatic shape, so that a plurality of the bodies, can be assembled together in a mutually adjacent or tessellated form to form a linear or two-dimensional array of the plurality of bodies. Correspondingly there is provided a linear or two-dimensional array of a plurality of a mutually adjacent or tessellated chambers, each chamber being associated with a respective acoustic transducer. This array can provide an apparatus for cleaning a surface which can have an overall shape and dimensions which are matched to the surface to be cleaned, for example a linear array for cleaning an elongate linear surface or a two-dimensional array for cleaning a large surface area. This provides a more efficient unitary apparatus for cleaning a surface which has plural closely adjacent chambers defined by respective bodies, with each chamber having acoustic energy introduced therein by a respective acoustic transducer. Each chamber/acoustic transducer assembly is configured to provide high quality or optimised cleaning for the surface to be cleaned, and the array provides an enlarged composite cleaning apparatus for increased cleaning efficiency.

The divider may comprise a membrane. The membrane may be substantially sealed with respect to the body around a perimeter of the membrane.

The membrane may be formed of a material that is substantially impedance matched to the cleaning liquid. The membrane may, therefore, facilitate the generation of an acoustic field in the second portion of the chamber, and thus the generation of higher pressure fluctuations at the surface to be cleaned. For example, the membrane may be formed of Rho-C rubber which is substantially impedance matched to water. A Rho-C membrane may, for example, have a thickness in the range 0.5 mm to 10 mm, but more preferably in the range 1-2 mm. Alternatively the membrane may be formed of another rubber that is substantially impedance matched to the intended cleaning liquid. An impedance matched membrane may generally be located at any position within the chamber, including a position at which an acoustic pressure antinode or an acoustic pressure node is formed in use (although it is preferable to position the membrane at or near to the distal end of the body). Preferably the material of the membrane is chosen so that the reflection coefficient between the membrane and the cleaning liquid is as close to zero as possible.

The membrane may be sufficiently thin that it does not, in use, substantially attenuate sound passing therethrough from the first portion of the chamber to the second portion of the chamber. The membrane may, therefore, be substantially non-invasive with respect to the acoustic field, and may facilitate the generation of an acoustic field in the second portion of the chamber, and thus the generation of higher pressure fluctuations at the surface to be cleaned. For example, the membrane may have a thickness in the range 5 to 100 microns, typically from 5 to 20 microns, or in the range 8 to 15 microns, or a thickness of approximately 10 microns. For example, the membrane may comprise a stainless steel or other metal sheet with a thickness of 10 microns. The membrane does not need to be formed of a material that is substantially impedance matched to the cleaning liquid (as described above) or formed of a material with specific acoustic properties that match the acoustic field at its location in use (as described below) if it is sufficiently thin that it does not, in use, substantially attenuate sound passing therethrough.

The membrane may be formed of a material with specific acoustic properties that match the acoustic field at its location in use. The membrane may, therefore, be substantially non-invasive with respect to the acoustic field, and may facilitate the generation of an acoustic field in the second portion of the chamber, and thus the generation of higher pressure fluctuations at the surface to be cleaned. For example, the membrane may comprise a thin metal wall that substantially coincides with an acoustic pressure antinode in the chamber when the apparatus is in use. As an example, consider a rigid-walled cubical chamber with internal dimensions of 100 mm by 100 mm and a height of H=100 mm cleaning a horizontal surface. If the speed of sound in the cleaning liquid is c=1500 m/s, then at 30 kHz there is a 3D resonant mode of the form (alpha, beta, gamma)=(0,0,4), where gamma is the number of acoustic pressure nodes contained within the vessel in the vertical direction, and where alpha and beta are the number of acoustic pressure nodes in each of the horizontal directions. In such a mode, an acoustic pressure antinode is formed x=25 mm above the surface to be cleaned, and so the thin metal membrane may be positioned accordingly (see FIG. 8). It should be noted that the speed of sound within the cleaning liquid may not be constant, but may be changed by a gas bubble population generated in or introduced into the cleaning liquid in use. The membrane position may be determined taking account of any change of the speed of sound within the cleaning liquid in use caused by a gas bubble population. The membrane may alternatively be positioned at a location that does not coincide with an acoustic pressure antinode, although positioning a metal wall at another location results in reduced efficiency.

The membrane may comprise reinforcement, for example in the form of stiffening rods or ribs. The reinforcement may be formed of the same material as the membrane itself, or alternatively may comprise a material different to that forming the main part of the membrane.

The divider may comprise an interface between an acoustic energy transmitting material located in the first portion of the chamber, wherein the acoustic energy transmitting material comprises a different material to the cleaning liquid and has an acoustic impedance that is similar to an acoustic impedance of the cleaning liquid. The acoustic energy transmitting material may, for example, comprise a solid or gel material with a similar acoustic impedance to that of the cleaning liquid. The acoustic energy transmitting material may, for example, comprise an agar gel or gelatine. The interface may be a plain interface, or alternatively may comprise a wall or membrane that is formed of a different material to the acoustic energy transmitting material. In embodiments where the acoustic energy transmitting material fills the first portion of the chamber the cleaning liquid may, in use, be present in the second portion of the chamber only. However, in other embodiments the first portion of the chamber may be only partially filled with the acoustic energy transmitting material, and cleaning liquid may also be present in the first portion of the chamber.

The divider may comprise an acoustic lens that, in use, focusses acoustic energy on the surface to be cleaned. Focussing acoustic energy on the surface to be cleaned allows efficient energy transfer from the acoustic transmitter to the surface to be cleaned with minimal transducer heating.

The lens may be a biconcave lens formed of a material with a sound speed greater than that of the cleaning liquid, for example (poly)methylmethacrylate (PMMA) or plastics with a sound speed greater than that of water. Alternatively the lens may take any other form that allows acoustic energy to be focussed on the surface to be cleaned.

The lens may act as the divider and divide the chamber into a first portion and a second portion, with the cleaning liquid and/or an acoustic energy transmitting material located in the first portion of the chamber in use. Alternatively, a lens may be included in the cleaning apparatus in addition to a membrane or interface as described above. At least one hole may be formed through the lens for allowing cleaning liquid to bleed, at any desired flow rate and/or flow velocity, from the first portion of the chamber into the second portion of the chamber, or alternatively a gap may be provided between the lens and a side wall of the body.

A cleaning apparatus including a lens instead of or in addition to the membrane or interface described above may be particularly useful for cleaning a surface that does not provide a rigid boundary or approximately rigid boundary, for example a carpet, because such cleaning apparatus does not require resonance to be generated within the chamber in order to provide efficient cleaning as described below.

The cleaning apparatus may comprise a plurality of the acoustic transducers located and oriented within the chamber such that acoustic energy generated by the plurality of transducers in use is focussed on the surface to be cleaned. The plurality of acoustic transducers may, for example, be arranged in an array across a domed roof of the chamber, or alternatively on a plurality of angled surfaces forming a roof of the chamber. Each acoustic transducer may be oriented and located to face towards a common point. Such cleaning apparatus may comprise a membrane, as described above. Alternatively or additionally such cleaning apparatus may comprise an acoustic lens, as described above. The plurality of acoustic transducers may be operated with phase delays to produce focussing or beam steering effects.

The divider may be located at or near to the distal end of the body. For example, where the divider is a membrane, the membrane may be located over the distal end of the body. Alternatively the divider may be located directly adjacent to the distal end of the body, or stepped back from the distal end of the body, for example by a distance in the range 1 mm to 60 mm, or 2 mm to 40 mm, or 5 mm to 10 mm Positioning the divider at or near to the distal end of the body may advantageously reduce the rate at which the cleaning liquid leaks out from the apparatus.

The cleaning liquid inlet may be arranged for flow of the cleaning liquid into the first portion of the chamber, the cleaning liquid inlet being fluidically connected to the cavity at a location inboard of the divider. In this case the cleaning liquid passes through or around the divider before coming into contact with the surface to be cleaned. Alternatively (or additionally) a cleaning liquid inlet may be arranged for flow of the cleaning liquid into the second portion of the cavity, the cleaning liquid inlet being fluidically connected to the cavity at a location outboard of the divider.

The divider may be adapted to, in use, allow cleaning liquid to bleed therethrough from the first portion of the chamber into the second portion of the chamber. The divider may, for example, comprise one or more holes or pores or otherwise porous regions via which the cleaning liquid can, in use, bleed through from the first portion of the chamber into the second portion of the chamber. Any number of holes may be used in any configuration or position on the divider. By using a divider to separate the cleaning liquid in the first portion of the chamber from the second portion of the chamber and only allowing a portion of the cleaning liquid to bleed through, it is possible to control the delivery of the cleaning liquid to the surface to be cleaned. In some embodiments of the present invention, a plurality of holes are provided extending through the divider for allowing cleaning liquid to bleed from the first portion of the chamber into the second portion of the chamber, and the plurality of holes may be provided in a regular or irregular array. The provision of such an array of holes has been found to provide enhanced cleaning of the surface. It has been found that for a given volume flow rate (e.g. litres per minute) of cleaning liquid through the holes, by directing the liquid flow at the surface to be cleaned, or against the divider, through a plurality of smaller holes as compared to one larger hole, enhances the cleaning effect.

The flow rate through the divider of cleaning liquid from the first portion of the chamber into the second portion of the chamber may be controlled or selected to provide enhanced cleaning, for example, the cleaning effect may be enhanced at faster flow rate, resembling a higher velocity liquid jet rather than a slow velocity liquid bleed, especially if the jet is directed onto the surface to be cleaned. The cleaning effect may also be enhanced if the feed of liquid into the first portion of the chamber is directed downwards, e.g. onto the membrane if the holes are above the membrane, in addition, a liquid flow may be directed into the second portion of the chamber, in addition to or alternative to liquid flow into the first portion of the chamber. Such a liquid feed directly into the second portion of the chamber may provide enhanced cleaning at higher flow velocity and if the flow is directed downwards onto the surface to be cleaned. Typically, the flow velocity of the liquid flow into the second portion of the chamber, either through the divider or directly into the second portion of the chamber, and optionally directed towards the surface to be cleaned, is from 0.25 to 5 metres per second, for example from 0.5 to 2 metres per second, e.g. about 1 metre per second.

The cleaning liquid inlet may be fluidically connected to the cavity at a location between the divider and the distal end of the body. In this case the cleaning liquid is delivered directly to the second portion of the chamber and the divider may be impermeable to the cleaning liquid. The first portion of the chamber may be filled with a separate body of the same liquid or alternatively with some other acoustic energy transmitting material, as described above.

The apparatus may comprise a plurality of the cleaning liquid inlets fluidically connected to the first and/or second portions of the chamber and fluidically connected to an inlet manifold.

The apparatus may comprise a skirt arranged around the distal end of the body adapted to retain the cleaning liquid in the second portion of the chamber in contact with the surface to be cleaned. The skirt may comprise a wall extending around an opening at the distal end of the body. The skirt may reduce residual cleaning liquid on the surface to be cleaned after cleaning, for example to leave behind only as much liquid as might be expected from a domestic mop. The cleaning liquid inlet may be formed in the skirt, in which case the cleaning liquid is delivered directly to the second portion of the chamber and the divider may be impermeable to the cleaning liquid. The skirt may, for example, extend outwardly from the distal end of the body by a distance in the range 3 mm to 10 mm. As an example, if the skirt extends 5 mm from the distal end of the body and the divider is stepped back from the distal end of the body by 5 mm then the distance between the divider and a terminal end of the skirt will be 10 mm. The skirt may be formed of rubber. However, a separate skirt is not necessary in all embodiments.

The apparatus may comprise a wet/dry vacuum device for removing excess cleaning liquid from the surface to be cleaned. The wet/dry vacuum device will also act to remove displaced contamination from the surface after cleaning.

The apparatus may comprise a cleaning liquid outlet for flow of the cleaning liquid out from the chamber. The cleaning liquid outlet is preferably fluidically connected to the first portion of the chamber. The apparatus may comprise a plurality of the cleaning liquid outlets fluidically connected to the first and/or second portions of the chamber and fluidically connected to an outlet manifold. The apparatus may be arranged to remove cleaning liquid from the chamber via the outlet and return the cleaning liquid to a reservoir from which the cleaning liquid is supplied to the chamber.

The apparatus may comprise an acoustic isolation device in the inlet and/or the outlet to prevent sound propagation out from the chamber.

The apparatus may comprise a liquid conditioning unit adapted to remove bubbles from the cleaning liquid supplied to the chamber. The liquid conditioning unit may, for example, comprise at least one of a settling vessel, a physical mesh, a cellular material, for example a porous open cell foam or sponge, and a vortex chamber. The liquid conditioning unit may substantially reduce the number of bubbles present in the cleaning liquid entering the chamber, which would otherwise attenuate the acoustic field. The liquid conditioning unit may be arranged upstream of the cleaning liquid inlet to remove bubbles from the cleaning liquid before the cleaning liquid is supplied to the chamber.

The cleaning apparatus may comprise a bubble generator adapted to generate or release bubbles in the cleaning liquid. The bubble generator may, for example, comprise the acoustic transducer used to introduce acoustic energy into the chamber or one or more additional transducers that generate bubbles cavitation; or one or more pairs of electrodes that generate bubbles using electrolysis; or a venturi system; or a bubble injection system including one or more bubble injecting needles. Electrodes may take the form of wires, plates, mesh or curved surfaces. The electrodes may be provided in or attached to the divider. The electrodes may be positioned adjacent to a hole or pore or porous region of the divider such that the flow of cleaning liquid through the hole or pore or porous region acts to disperse bubbles generated by the electrodes, and attenuation of the acoustic energy is minimised. An ionically conducting membrane may be positioned between electrodes to facilitate electrolytic bubble generation, especially when the ionic conductivity of the cleaning liquid is low.

The bubbles generated by the bubble generator may, for example, have radii in the range 0.1 to 150 microns, or 1 to 100 microns, or 10 to 50 microns. The bubbles are preferably of resonant size or smaller. For example, for air bubbles in water driven at 40 kHz, the bubbles may have radii in the range 30 to 75 microns.

The bubble generator may arranged to introduce bubbles into the cleaning liquid upstream of the cleaning liquid inlet and/or in the first portion of the chamber and/or at the divider and/or in the second portion of the chamber. Introducing bubbles into the cleaning liquid at the divider and/or in the second portion of the chamber only may reduce acoustic attenuation in the first portion of the chamber and ensure a sufficient concentration of bubbles at the surface to be cleaned.

The divider may be configured or treated so as to reduce or avoid the divider acting to trap bubbles in the chamber, for example bubbles rising in the liquid below the divider to contact the lower surface of the divider and/or bubbles formed and/or growing on the upper surface of the divider or which are urged downwardly against the upper surface. Either or both of the upper and lower surfaces of the divider may be configured or treated so as to be hydrophilic, for example by treatment with one or more hydrophilic chemical agents or by plasma treatment of the surface to introduce oxygenated polar groups onto or into the surface of the divider. In some embodiments, fluid flow through the chamber is controlled so as at least partially to sweep bubbles away from the upper and/or lower surface of the divider.

Such a hydrophilic surface of the divider may be advantageous against bubble entrapment when the cleaning liquid is aqueous. However, in some embodiments of the present invention the cleaning liquid may be non-aqueous, for example an oil, which may be hydrophobic. A non-aqueous cleaning liquid may be preferred when the surface to be cleaned has previously been in contact with a non-aqueous liquid, for example an oil. When a hydrophobic cleaning liquid is employed, either or both of the upper and lower surfaces of the divider may be configured or treated so as to be hydrophobic so as to reduce or avoid the divider acting to trap bubbles in the chamber.

The bubble generator may use positive feedback to allow a mode to be excited as the bubble population changes the speed of sound in the cleaning liquid. For example, where the driving frequency is below a particular mode frequency for bubble-free liquid but sufficiently close to generate cavitation, cavitation occurs and the bubble population increases, resulting in a decrease in the speed of sound in the liquid. This decrease in the speed of sound in turn increases cavitation and further reduces the speed of sound in the liquid until the mode frequency in the chamber is pulled to the transducer frequency.

The apparatus may comprise a first controller for the bubble generator which is adapted to control the bubble generator to generate or release pulses of bubbles.

The apparatus may comprise a second controller for the acoustic transducer which is adapted to control the acoustic transducer to generate pulses of acoustic energy. This may be done, for example, by switching the acoustic transducer on and off intermittently, or alternatively by providing amplitude or frequency modulation.

The first and second controllers may be coordinated so that pulses of bubbles and pulses of acoustic energy are generated with a mutually controlled time relationship. For example, the pulses of bubbles and pulses of acoustic energy may be timed to impact the surface to be cleaned substantially simultaneously. The use of such a mutually controlled time relationship may allow efficient cleaning with a reduced requirement for bubbles so that sound attenuation in the chamber is minimised.

The apparatus may comprise a modulator to provide an amplitude or frequency modulation of the pulses of acoustic energy.

The acoustic transducer may be adapted to be driven at a frequency in the range 20 kHz to 10 MHz. For example, the acoustic transducer may be adapted to be driven at a frequency in the range 20 kHz to 500 kHz, or 20 kHz to 200 kHz, or 20 kHz to 50 kHz. In two preferred embodiments the frequency is 20 kHz or 40 kHz. In another preferred embodiment, the acoustic transducer is adapted to be driven at a frequency in the range at least 50 kHz, preferably at least 60 kHz, and more preferably in the range from 60 to 140 kHz. Other frequencies are also possible, for example as low as 1 Hz in exceptional cases, depending on the intended application.

The pulses of acoustic energy may be controlled to enhance bubble removal from the chamber. It has been found that whilst the acoustic energy is turned off, bubbles can rise out of the cavity of the chamber towards the vents. Accordingly, an off-time between acoustic energy pulses can help remove bubbles from the chamber, which bubbles may otherwise attenuate the sound field and reduce the cleaning. When the acoustic energy is on, some bubbles are prevented from rising out of the chamber by Bjerknes forces, and so an off-time between acoustic energy pulses can help flow and buoyancy remove the bubbles. Yet another advantage of acoustic energy pulsing is that at the commencement of a subsequent pulse, in the time window around the start of that pulse there are many frequencies present (as shown by Fourier transform of the start of a pulse). It has been found that for that short period after each pulse starts, bubbles which have sizes that are far from achieving resonance within the sound field, can respond to some energy that is present at the start of the pulse. As such, for example, it has been found that the start of the pulse can provide to large bubbles sticking to the surface being cleaned (i.e. the floor) or divider/membrane a small impulsive force, or 'kick', which can knock the bubbles from the surface or divider/membrane. Accordingly, by pulsing the sound field (particularly with a pulse waveform that has sudden starts like a square wave), it has been found that some of the unwanted bubbles (particularly large bubbles) that are attached to the floor or divider/membrane can be dislodged, thereby enhancing the cleaning efficiency of the apparatus.

Walls of the chamber may be formed of an acoustically rigid material or a pressure release material. An acoustically rigid material is preferred in order to maximise the area cleaned by the apparatus up to the edges of the chamber. The material may, for example, be a metal. Alternatively a transparent plastic, glass or acrylic material may be selected in order to allow inspection of the chamber in use.

The apparatus may further comprise an aggressive or chaotropic agent introduction system for introducing one or more aggressive or chaotropic agents. The aggressive or chaotropic agent may include, for example, ozone, chlorine and/or hydrogen peroxide. The aggressive or chaotropic agent may be added by injection and/or by electrochemical generation within the apparatus. The aggressive or chaotropic agents may be added or generated at the divider and/or in the second chamber to achieve high concentrations in close proximity to the surface to be cleaned. Alternatively, the aggressive or chaotropic agents may be added or generated at the liquid conditioning unit.

The apparatus may comprise a chemically active agent introduction system for introducing one or more chemically active agents. The chemically active agent may include, for example, a detergent, a surfactant and/or a biocide. A surfactant may improve control of bubble diameters by reducing the likelihood of bubble coalescence.

The distal end of the body may be substantially planar. The apparatus may therefore be particularly suited to cleaning a substantially planar surface. Alternatively the distal end of the body may have some other shape adapted to clean a surface having a corresponding shape. The apparatus may be provided with casters for positioning the apparatus relative to the surface to be cleaned.

The acoustic transducer may be disposed in or on a top wall of the body opposing the distal end of the body. However, the acoustic transducer does not need to directly oppose the surface to be cleaned, and may alternatively be disposed in or on a side wall of the body.

The apparatus may include multiple acoustic transducers. Acoustic transducers may be provided in or on one or both of the top wall of the body and the side wall of the body. The acoustic transducers may be operated with phase delays, for example to produce focussing or beam steering effects.

A surface cleaning assembly may include multiple apparatuses according to the first aspect of the invention. A surface cleaning assembly may include multiple apparatuses arranged, for example, in one or more rows or in a circle. Such a surface cleaning assembly may be capable of cleaning a larger area of a surface to be cleaned in a given time that a single assembly operated alone.

Where multiple apparatuses are included in a surface cleaning assembly, it may be advantageous to use square or rectangular bodies in order to allow the bodies to be arranged side-by-side with minimal spaces between the individual apparatuses.

The body of at least one apparatus may share a common side wall with a body of at least one other apparatus. Such an arrangement may reduce the space between the respective chambers formed by the adjacent apparatuses, thereby allowing more consistent cleaning. Such an arrangement may also reduce the weight and material cost of the surface cleaning assembly.

Multiple apparatuses may be supplied with cleaning liquid in parallel. Alternatively, multiple apparatuses may be connected in series with the cleaning liquid outlet(s) of one or more of the apparatuses being fluidically connected to the cleaning liquid inlet(s) of one or more of the other apparatuses such that cleaning liquid is delivered in series from each apparatus to the adjacent apparatus.

Where one or more apparatuses share a common side wall with one or more adjacent apparatuses, one or more of the common side walls may include one or more holes or vents for allowing the passage of cleaning liquid between adjacent cleaning apparatuses. Such an arrangement may reduce the need for piping between adjacent multiple apparatuses connected in series.

A single common skirt may be shared by multiple adjacent cleaning apparatuses.

A second aspect of the invention provides a method of cleaning a surface, the method comprising the steps of: a) providing an apparatus including a body defining a cavity and a divider located in or at the end of the cavity; b) positioning a distal end of the apparatus in the vicinity of a surface to be cleaned such that the surface to be cleaned forms an end wall of a chamber including the cavity, the divider dividing the chamber into a first portion and a second portion, the second portion of the chamber being in fluid communication with the surface to be cleaned; c) supplying cleaning liquid to the second portion of the chamber such that the cleaning liquid engages the surface to be cleaned; d) using an acoustic transducer to introduce acoustic energy into the chamber; e) passing the acoustic energy through the divider from the first portion of the chamber to the second portion of the chamber, thereby generating pressure fluctuations at the surface to be cleaned.

The method may comprise generating acoustic resonance within the chamber. Since the surface to be cleaned forms an end wall of the chamber, cleaning will be more efficient for surfaces with an acoustic impedance significantly higher than that of the cleaning liquid or acoustically rigid surfaces, which allow a stronger resonant structure to be achieved. However, cleaning of surfaces other surfaces is also possible because the walls of the body enable a mode to be generated even when the surface to be cleaned is not acoustically rigid.

The method may comprise forming an acoustic pressure antinode at or adjacent to the surface to be cleaned. It is generally preferable to form an acoustic pressure antinode at the surface to be cleaned. However, in some cases the acoustic pressure antinode may be spaced apart from the surface to be cleaned, for example by ⅛th of a wavelength, especially when cleaning a non-planar surface, for example surfaces including ridges, notches or other discontinuities.

The method may comprise using the divider to focus the acoustic energy on the surface to be cleaned, the divider comprising a lens. Where a lens is used to focus the acoustic energy, the surface to be cleaned is not required to have any particular acoustic properties.

The cleaning liquid may be supplied into the first portion of the chamber, and the method may comprise allowing the cleaning liquid to bleed through the divider from the first portion of the chamber into the second portion of the chamber.

The method may comprise using a liquid conditioning unit to remove bubbles from the cleaning liquid supplied to the chamber.

The method may comprise using a bubble generator to generate or release bubbles into the cleaning liquid.

The method may comprise using a first controller to control the bubble generator to generate or release pulses of bubbles into the cleaning liquid.

The method may comprise coordinating the first controller and a second controller used to control the acoustic transducer to generate pulses of acoustic energy so that pulses of bubbles and pulses of acoustic energy are generated with a mutually controlled time relationship.

The pulses of gas bubbles and the pulses of acoustic energy may impact the surface substantially simultaneously.

The method may comprise controlling the acoustic energy to cause non-inertial bubble motion at the surface to be cleaned.

The method may comprise controlling the acoustic energy to cause inertial cavitation of the bubbles at the surface to be cleaned and/or at a distance from the surface to be cleaned.

The method may comprise controlling the acoustic energy to generate surface waves in the bubbles and/or microstreaming.

The method may comprise employing modulated acoustic energy to cause the non-inertial bubble motion and/or inertial cavitation and/or to generate the surface waves and/or microstreaming.

The method may comprise causing the bubbles to enter cavities, recesses or pores formed in the surface to be cleaned. The bubbles may be driven towards and into the cavities, recesses or pores by the acoustic energy.

The method may comprise using the acoustic energy to excite the surfaces of the bubbles while the bubbles are in the cavities, recesses or pores.

The method may comprise using water as the cleaning liquid. The water may optionally include one or more aggressive or chaotropic agents or chemically active agents as described above.

The method may comprise maintaining the distal end of the body at a distance of 5 mm to 8 mm from the surface to be cleaned.

The method of the second aspect of the invention may be carried out using apparatus including any of the features described above in relation to the first aspect of the invention. The method of the second aspect may further include additional steps of using any of the features described above in relation to the first aspect of the invention.

A third aspect of the invention provides a method of cleaning a surface submerged in an underwater environment, for example a ship hull. The method comprises the steps of: a) providing an apparatus including a body defining a cavity; b) positioning a distal end of the apparatus in the vicinity of a surface to be cleaned such that the surface to be cleaned forms an end wall of a chamber including the cavity, the surface to be cleaned being submerged in an underwater environment; c) supplying cleaning liquid to the chamber such that the cleaning liquid engages the surface to be cleaned; d) using an acoustic transducer to introduce acoustic energy into the chamber; e) passing the acoustic energy through the chamber, thereby generating pressure fluctuations at the surface to be cleaned.

When the surface to be cleaned is submerged in an underwater environment, the divider of the apparatus of the first aspect of the present invention can be omitted. Apart from the omission of a divider, the method of the third aspect of the invention may be carried out using apparatus including any of the features described above in relation to the first aspect of the invention. The method of the third aspect may further include additional steps of using any of the features described above in relation to the first aspect of the invention.

Acoustic cavitation occurs when a bubble that is surrounded by liquid changes volume under the action of a varying pressure field. Bubble volume change is oscillatory, but can sometimes last for less than one oscillation. Inertial cavitation occurs when motion and collapse of the bubble is dominated by the inertia of in-rushing liquid. During inertial cavitation high speed liquid jets and shock waves can be created through rapid bubble involution. Inertial cavitation can lead to various effects, including free radical generation, sonoluminescence, and sonochemical effects. In contrast, during non-inertial bubble motion, perturbations in the bubble gas pressure (rather than the liquid inertia) control the dynamics of the pulsation. Non-inertial bubble motion and non-inertial cavitation include a range of phenomena, including the generation of surface waves on the bubble wall, microstreaming fluid currents in the cleaning liquid and/or shear in the cleaning liquid, radiation force (especially primary and secondary Bjerknes force) effects, acoustically-driven bubble fragmentation and coalescence, bubble motion under acoustic radiation forces, and spherical pulsation with an amplitude insufficient to generate the effects associated with inertial collapse.

Inertial and/or non-inertial behaviour may be controlled, for example, by varying the zero-to-peak pressure amplitude. For water with 20 kHz ultrasound in normal room conditions of temperature and pressure, a zero-to-peak pressure amplitude below approximately 120 kPa generates non-inertial behaviour. Inertial behaviour is generated in normal room conditions of temperature and pressure for some bubbles (depending on bubble size) for zero-to-peak pressure amplitudes above approximately 120 kPa, with non-inertial behaviour simultaneously being generated for other bubbles. At the minimum acoustic pressure amplitude that can generate inertial cavitation in a liquid, only bubbles of the optimum size undergo inertial cavitation. However, as the zero-to-peak pressure amplitude increases, the range of bubble sizes that undergo inertial cavitation is increased, and so the number of bubbles undergoing inertial cavitation is increased. In this way non-inertial bubble motion and/or inertial cavitation can be generated by the apparatus, depending on the ultrasound frequency and the range of bubble sizes. Inertial behaviour may also be promoted by decreasing the driving frequency and by optimising the bubble size for inertial behaviour.

BRIEF DESCRIPTION OF FIGURES

Embodiments of the present invention will now be described by way of example only, with reference to the accompanying drawings, in which.

DETAILED DESCRIPTION OF EMBODIMENTS OF THE INVENTION

Figure 1:
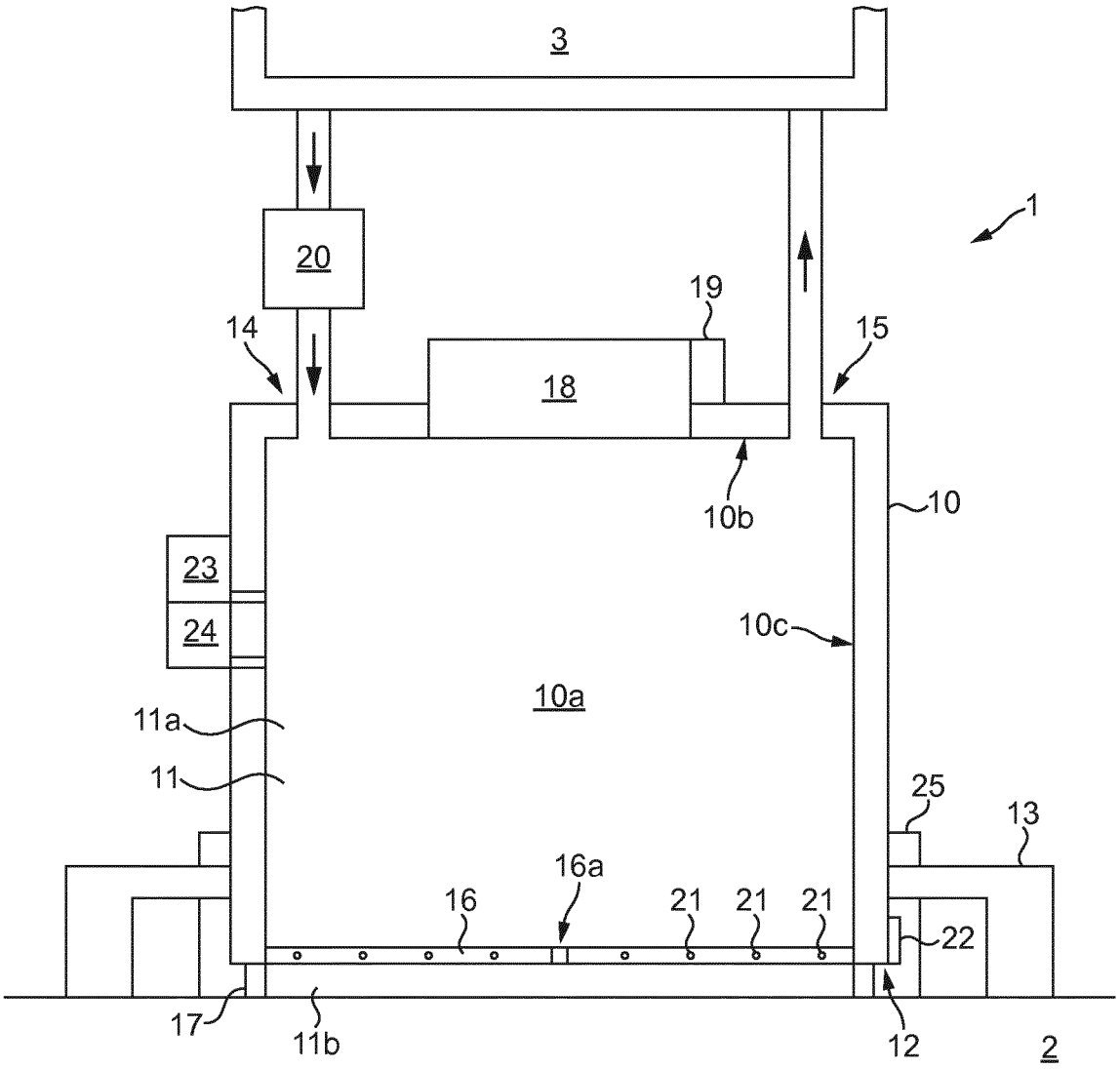
FIG. 1 is a schematic view of an apparatus for cleaning a surface according to a first embodiment of the present invention.

FIG. 1 shows a cleaning apparatus 1 in accordance with the present invention. The apparatus 1 comprises a metal or polymeric (for example acrylic) body 10 defining a cavity 10*a* in the form of a circular, square or rectangular cylinder. The body 10 terminates in a planar distal end 12 that is, in use, held in the vicinity of a planar surface to be cleaned 2 (the surface), as shown in FIG. 1. When the body 10 is held with the distal end 12 of the body 10 in the vicinity of the surface 2, the surface 2 forms an end wall of a chamber 11, the chamber 11 including both the cavity 10*a* formed within the body 10 and also a further region extending between the distal end 12 of the body 10 and the surface 2. (Other possible arrangements of the cavity and the chamber that may be used in different embodiments of the present invention are discussed below with reference to FIG. 5). The body 10 is provided with casters 13 for positioning the apparatus 1 relative to the surface 2.

The apparatus 1 further comprises a cleaning liquid inlet 14 through which a cleaning liquid such as water can be supplied to the cavity 10*a* from a cleaning liquid reservoir 3, and a cleaning liquid outlet 15 through which the cleaning liquid can be removed from the cavity 10*a* and returned to the cleaning liquid reservoir 3.

The apparatus 1 further comprises a divider 16 located at the end of the cavity 10*a* (and at the distal end 12 of the body 10). When the apparatus 1 is positioned with the distal end 12 of the body 10 in the vicinity of a surface to be cleaned 2 with the surface forming an end wall of a chamber 11 including the cavity 10*a* (as shown in FIG. 1), the divider divides the chamber 11 into a first portion 11*a* and a second portion 11*b*. The first portion 11*a* of the chamber 11 is bounded by a top wall 10*b* or end wall of the body 10 that opposes the distal end 12, by the divider 16, and by a side wall 10*c* of the body 10 that extends between the top wall 10*b* and the divider 16. The second portion 11*b* of the chamber 11 is bounded by the divider 16, by the surface 2, and by a flexible skirt 17, for example a rubber skirt, that extends between the body 10 and the surface 2. In the embodiment shown in FIG. 1 the divider 16 is located at the distal end 12 of the body 10 and so the second portion 11*b* of the chamber 11 is located wholly outside the body 10, but other possible arrangements are discussed below with reference to FIG. 3. The second portion 11*b* of the chamber is in fluid communication with the surface 2 when the apparatus is in position for use so that cleaning liquid in the second portion 11*b* of the chamber 11 can directly engage the surface 2 and effect cleaning, as described below.

The divider 16 is a thin sheet or membrane formed of a material that is substantially impedance matched to the cleaning liquid. Where the cleaning liquid is water, a Rho-C rubber membrane with an acoustic impedance of approximately 1,500,000 Rayls may be used, although other materials with other acoustic impedances may also be used depending on the intended cleaning liquid. The divider 16 is sealed with respect to the body 10 around its perimeter, and is generally impervious to water, except for a 0.9 mm diameter hole 16*a* formed through the divider that provides fluid communication between the first portion 11*a* of the chamber 11 and the second portion 11*b* of the chamber 11.

The cleaning liquid inlet 14 and the cleaning liquid outlet 15 are both located inboard of the divider 16 so that cleaning liquid is delivered to and removed from the first portion 11*a* of the chamber 11.

An acoustic transducer 18 is mounted on the top wall 10*b* of the body 10 and arranged to introduce acoustic energy into the chamber 11. The acoustic transducer 18 is controlled by a controller 19 and can be driven at a frequency of 20 kHz to 20 MHz. A modulator allows amplitude or frequency modulation of pulses of acoustic energy. Acoustic isolation devices (not shown) in the cleaning liquid inlet 14 and the cleaning liquid outlet 15 prevent sound propagation out from the chamber 11.

The acoustic transducer 18 is operable to, in use, generate acoustic resonance within the chamber 11 when the apparatus 1 is positioned on or adjacent to a surface to be cleaned 2 (as shown in FIG. 1) and the chamber 11 is filled with cleaning liquid, with an acoustic pressure antinode being formed at or adjacent to the surface 2.

A liquid conditioning unit 20 is located upstream of the cleaning liquid inlet 14, and is adapted to remove bubbles from the cleaning liquid supplied to the chamber 11, for example with a physical mesh to substantially reduce the number of bubbles present in the cleaning liquid entering the chamber 11, which would otherwise attenuate the acoustic field.

A bubble generator 21 comprising electrodes in the form of wires is built into the divider 16 for generating bubbles in the cleaning liquid. The bubble generator is controlled by a controller 22, and generates bubbles with radii in the range 0.1 to 100 microns. The bubble generator controller 22 may be operated to generate bubbles in timed pulses.

An aggressive or chaotropic agent introduction system 23 can be used to introduce one or more aggressive or chaotropic agents into the first portion 11*a* of the chamber 11*b*, for example ozone, chlorine and/or hydrogen peroxide. A chemically active agent introduction system 24 can be used to introducing one or more chemically active agents into the cleaning liquid, for example a detergent, a surfactant and/or a biocide.

Operation of the apparatus will now be described.

In use, the apparatus is positioned on the surface to be cleaned 2 with the casters 13 holding the body 10 such that the distal end 12 and the divider 16 are spaced apart from the surface by approximately 5 mm to 8 mm and the surface 2 forms an end wall of the chamber 11 including the cavity 10*a*. Water (or another cleaning liquid) is treated by the liquid conditioning unit 20 to remove bubbles and supplied to the first portion 11*a* of the chamber 11 via the cleaning liquid inlet 14. The water fills the first portion 11*a* of the chamber 11, and is also allowed to bleed through the hole 16*a* in the divider 16 into the second portion 11*b* of the chamber 11. The skirt 17 retains the water in the second portion 11*b* of the chamber 11 and in contact with the surface 2. In one mode of operation water may be supplied through the inlet 14 at a rate of 1 to 2 $dm^3$/min while water bleeds through the hole 16*a* at a rate of 1 to 5 $cm^3$/s.

Figure 2:
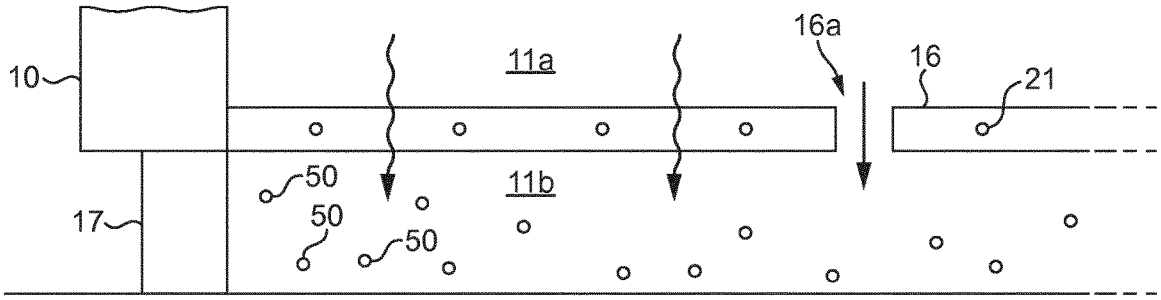
FIG. 2 is a schematic view of the interface between the apparatus of FIG. 1 and the surface in use.

When the chamber 11 is filled with water, the ultrasonic transducer 18 is used to introduce acoustic energy into the chamber 11. The divider 16, which is formed of a material that is substantially impedance matched to the cleaning liquid, allows acoustic energy to pass therethrough from the first portion 11*a* of the chamber 11 into the second portion 11*b* of the chamber 11, as shown in FIG. 2, and a strong acoustic field is generated in the lower portion 11*a* of the chamber 11. The surface 2 forms an acoustically rigid end wall of the chamber 11, and acoustic resonance is generated within the chamber 11, with an acoustic pressure antinode being formed at or adjacent to the surface 2. In this way pressure fluctuations are generated at the surface 2. (The same apparatus can also be used to clean a surface that is not acoustically rigid because the walls of the body 10 enable a mode to be generated even when the surface to be cleaned is not acoustically rigid. However, cleaning is less efficient for non-rigid surfaces.)

The bubble generator 21 is operated to generate bubbles 50 in the second portion 11*b* of the chamber 11, as shown in FIG. 2. The bubbles are driven towards the surface by the acoustic field in the chamber 11.

The acoustic transducer 18 may be operated to control the acoustic energy in the chamber 11 to cause non-inertial bubble motion at the surface 2. The acoustic transducer may, for example, be operated at a frequency of 20 kHz with a zero-to-peak pressure amplitude of well below 120 kPA, for example 90 kPa.

By controlling the acoustic energy to cause non-inertial bubble motion at the surface 2, the apparatus 1 provides enhanced cleaning of the surface without subjecting the surface to the stresses and possible damage that may result from inertial cavitation.

Alternatively, or in addition, the acoustic transducer 18 may be operated to control the acoustic energy in the chamber 11 to cause inertial cavitation of the bubbles at the surface 2 and/or at a distance from the surface 2. By controlling the acoustic energy to cause inertial cavitation of the bubbles at the surface 2 and/or at a distance from the surface 2, the apparatus 1 may provide enhanced cleaning for tougher surfaces. The acoustic transducer may, for example, be operated at a frequency of 20 kHz with a zero-to-peak pressure amplitude of well above 120 kPA, for example 250 kPa.

As the zero-to-peak pressure amplitude is increased, the range of bubble sizes that undergo inertial cavitation is increased and so the number of bubbles undergoing inertial cavitation is increased. In this way non-inertial bubble motion and/or inertial cavitation can be generated by the apparatus, depending on the ultrasound frequency and the range of bubble sizes.

Alternatively, or in addition, the acoustic transducer 18 may be operated to control the acoustic energy in the chamber 11 to generate surface waves in the bubbles and/or microstreaming.

Surface waves may be controlled by varying the zero-to-peak pressure amplitude and/or the ultrasound frequency and/or bubble size. In general, the closer a bubble is to its pulsation resonance size, the lower the threshold acoustic pressure required to excite the Faraday wave (and other related waves).

The sound field may be continuous or alternatively amplitude or frequency modulated, and the cleaning operation may comprise employing modulated acoustic energy to cause the non-inertial bubble motion and/or inertial cavitation and/or to generate the surface waves and/or microstreaming.

Where the surface 2 comprises cavities, the cleaning operation may include causing the bubbles to enter cavities, recesses or pores formed in the surface 2 and using the acoustic energy to excite the surfaces of the bubbles while the bubbles are in the cavities, recesses or pores.

In one mode of operation, the bubble generator controller 22 may be used to control the bubble generator 21 to generate pulses of bubbles, instead of generating bubbles continuously. The acoustic transducer controller 19 may be used to control the acoustic transducer 18 to generate pulses of acoustic energy. The pulses of bubbles and the pulses of acoustic energy may be generated with a mutually controlled time relationship, for example to impact the surface substantially simultaneously. In this way it is possible to operate the transducer more efficiently by only generating acoustic energy in pulses and by reducing attenuation caused by the bubbles.

A wet/dry vacuum device 25 is operated to remove excess water, as well as any displaced contamination. The skirt 17 generally retains the water within the second portion 11*b* of the chamber 11 and prevents the water from leaking out from the apparatus in large quantities. The apparatus 1 therefore leaves behind only as much liquid as might be expected from a domestic mop. As water leaks out from the second portion 11*b* of the chamber 11 under the skirt 17 and is removed by the wet/dry vacuum device 23, it is replenished as water continues to bleed through the hole 16*a* from the first portion 11*a* of the chamber 11 into the second portion 11*b* of the chamber 11.

The apparatus 1 can be moved across the surface 2 to clean a larger area, or alternatively held stationary at a single location to provide localised cleaning.

Figure 3A:
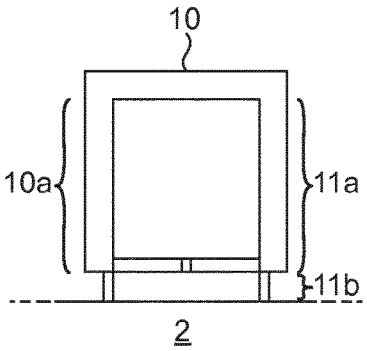
FIG. 3 is a schematic view of various different arrangements of a cavity and a chamber that may be used in different embodiments of the present invention.
Figure 3B:
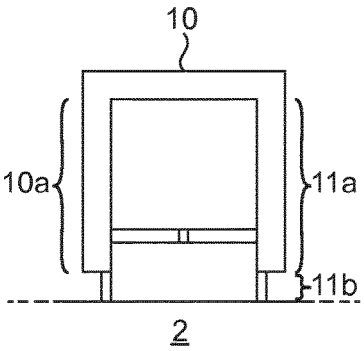
Figure 3C:
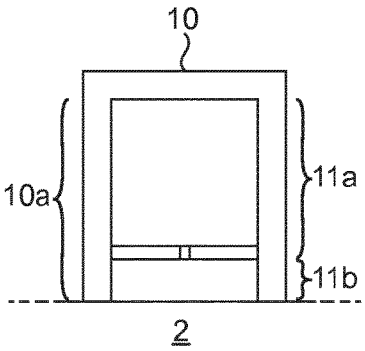

In the embodiment described with reference to FIG. 1, the divider 16 is located at the distal end of the cavity 10*a* and so the first portion 11*a* of the chamber 11 is located wholly within the cavity 10*a* and the second portion 11*b* of the chamber 11 is located wholly outside the cavity 10*a*, as illustrated in FIG. 3*a*. However, in an alternative embodiment, the divider 16 may be stepped back from the distal end of the cavity 10*a*, such that a part of the second portion 11*b* of the chamber 11 is located within the cavity 10*a*, as illustrated in FIG. 3*b*. In another alternative embodiment, the skirt may be omitted and the distal end 12 of the body 10 may lie substantially directly on the surface, such that substantially all of the second portion 11*b* of the chamber 11 is located within the cavity 10*a*, as illustrated in FIG. 3*c*.

In the embodiment described with reference to FIG. 1, the divider 16 is formed of a material that is substantially impedance matched to the cleaning liquid to allow acoustic energy to pass efficiently therethrough from the first portion 11*a* of the chamber 11 into the second portion 11*b* of the chamber 11 to generate a strong acoustic field in the second portion 11*b* of the chamber 11. However, in an alternative embodiment the divider 16 may alternatively (or additionally) be sufficiently thin that it does not, in use, substantially attenuate sound passing therethrough from the first portion 11*a* of the chamber 11 to the second portion 11*b* of the chamber 11. In this way the divider 16 may be substantially non-invasive with respect to the acoustic field, and may facilitate the generation of an acoustic field in the second portion 11*b* of the chamber 11, and thus the generation of higher pressure fluctuations at the surface 2. In another alternative embodiment, the divider 16 may be formed of a material with specific acoustic properties that match the acoustic field at its location in use (for example, the divider may comprise a thin metal wall that substantially coincides with an acoustic pressure antinode in the chamber when the apparatus is in use), and therefore be substantially non-invasive with respect to the acoustic field. In each case, the divider 16 is adapted to allow efficient energy transfer from the acoustic transducer 18 to the surface 2 with minimal transducer heating.

Figure 4:
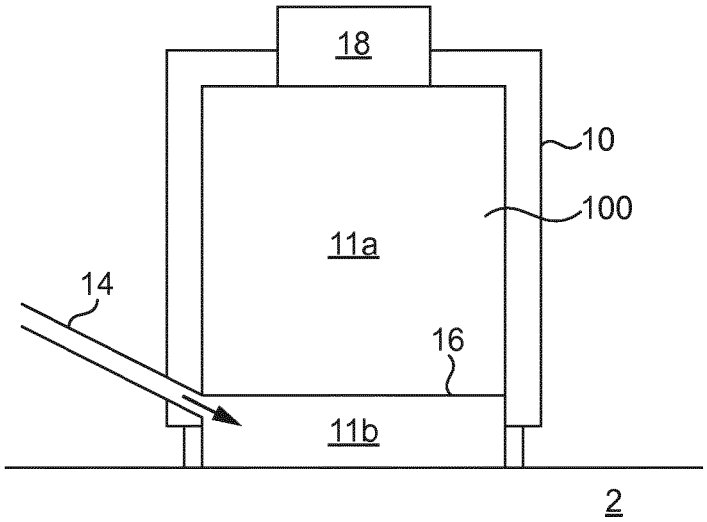
FIG. 4 is a schematic view of an alternative apparatus for cleaning a surface according to a second embodiment of the present invention.

In the embodiment described with reference to FIG. 1, the cleaning liquid is supplied into the first portion 11*a* of the chamber 11 and allowed to bleed through a hole 16*a* formed in the divider 16 to reach the second portion 11*b* of the chamber 11. However, in an alternative embodiment the water (or other cleaning liquid) may instead be supplied directly to the second portion 11*b* of the chamber 11, as shown in FIG. 4. In such an embodiment the first portion 11*a* of the chamber 11 may instead be filled with a different acoustic energy conducting material 100, for example a gel, as shown in FIG. 4. In such an embodiment the divider may simply take the form of an interface between the acoustic energy conducting material 100 and the second portion 11*b* of the chamber 11. The acoustic energy transmitting material should have a similar acoustic impedance to that of the cleaning liquid to enable efficient operation of the apparatus as described above in relation to the apparatus of FIG. 1. It will be appreciated by the person skilled in the art that the features described above in relation to the embodiment of FIG. 1 may also be applied to the embodiment shown in FIG. 4.

Figure 5:
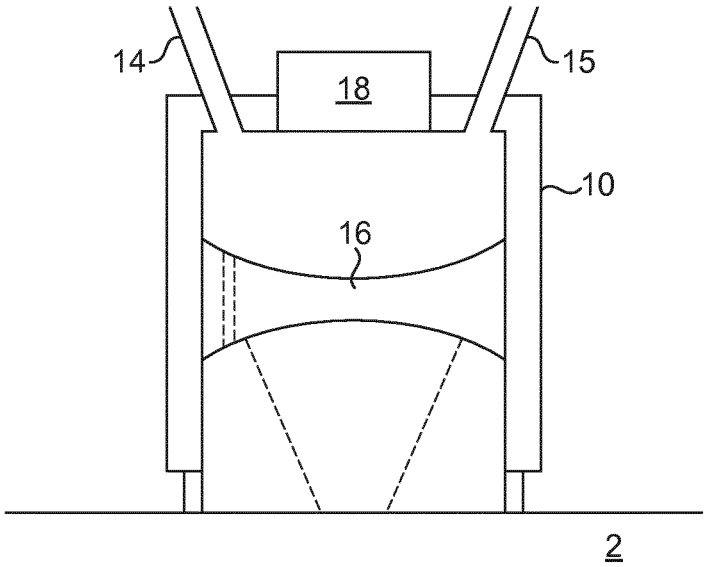
FIG. 5 is a schematic view of an another alternative apparatus for cleaning a surface according to a third embodiment of the present invention.

In another alternative embodiment, the divider may take the form of an acoustic lens that, in use, focuses acoustic energy introduced into the chamber 11 by the acoustic transducer 18 on the surface 2, as shown in FIG. 5. Focussing acoustic energy on the surface to be cleaned allows efficient energy transfer from the acoustic transducer 18 to the surface to be cleaned 2 with minimal transducer heating. A cleaning apparatus including a lens instead of (or in addition to) the membrane or interface described above may be particularly useful for cleaning a surface that does not provide a rigid boundary or approximately rigid boundary, for example a carpet, because such cleaning apparatus does not require resonance to be generated within the chamber in order to provide efficient cleaning, as described above. It will be appreciated by the person skilled in the art that the features described above in relation to the embodiments of FIGS. 1 and 4 may also be applied to the embodiment shown in FIG. 5. For example, the cleaning liquid may be introduced either into a first portion 11*a* of the chamber 11 formed between a top wall of the body and the lens, or into a second portion 11*b* of the chamber 11 formed between the lens and a surface on which the apparatus is placed. In addition, the first portion 11*a* of the chamber 11 may be filled with the cleaning liquid (as in the embodiment of FIG. 1), or alternatively filled with a different acoustic energy conducting material, for example a gel (as in the embodiment of FIG. 4).

Figure 6:
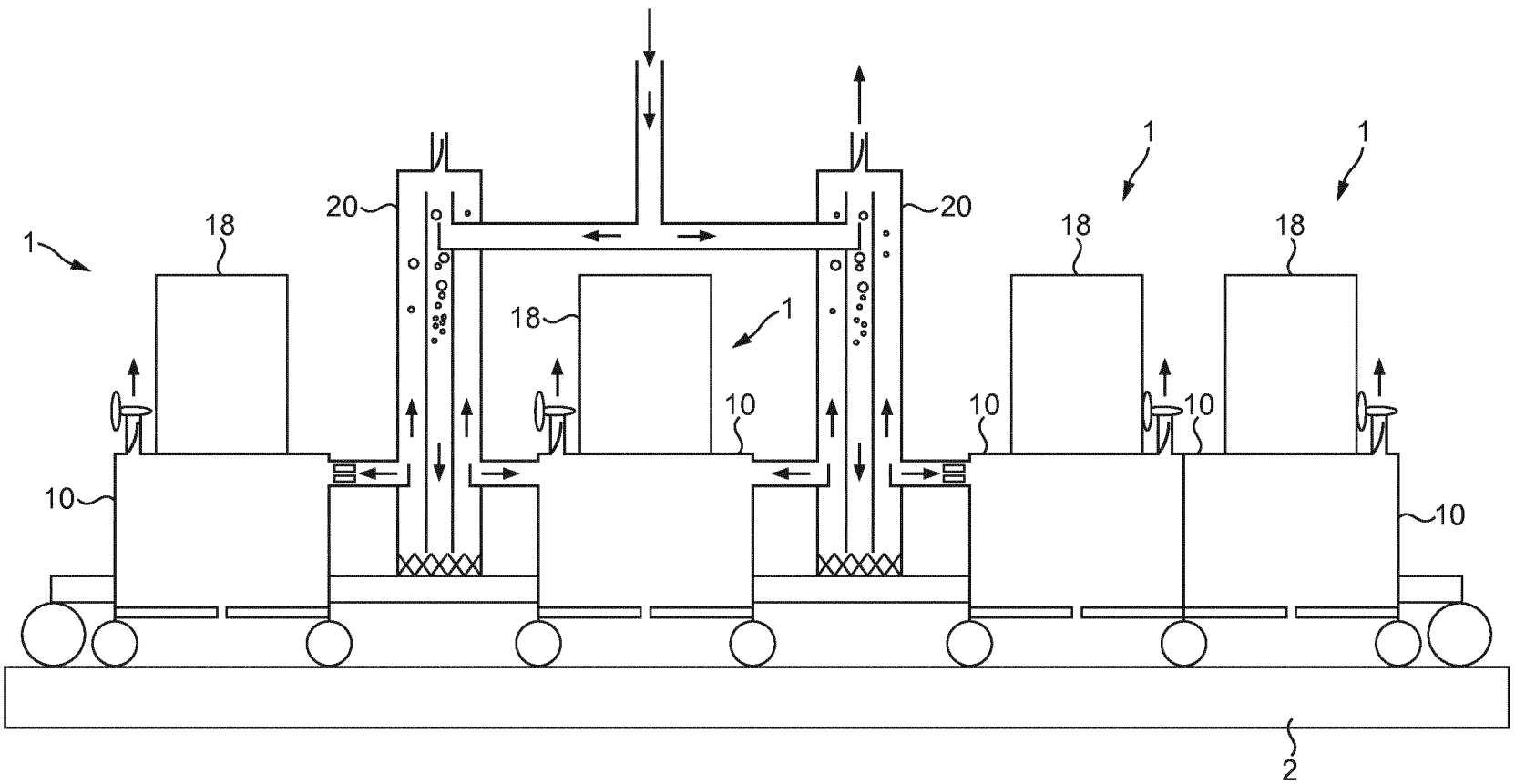
FIG. 6 is a schematic view of a cleaning assembly including multiple apparatuses according to a fourth embodiment of the present invention.

A surface cleaning arrangement 1000 may include multiple cleaning apparatuses 1 as described above, for example as shown in FIG. 6. The multiple cleaning apparatuses need not be identical. In some embodiments, a surface cleaning arrangement 1000 may include an array of apparatuses of the first embodiment, the second embodiment and/or the third embodiment together in a single array. In the embodiment shown in FIG. 6, the two cleaning apparatuses located furthest to the right share a common side wall. In other embodiments the cleaning apparatuses may each be formed with at least one side wall that is shared with at least one adjacent cleaning apparatus.

Figure 7:
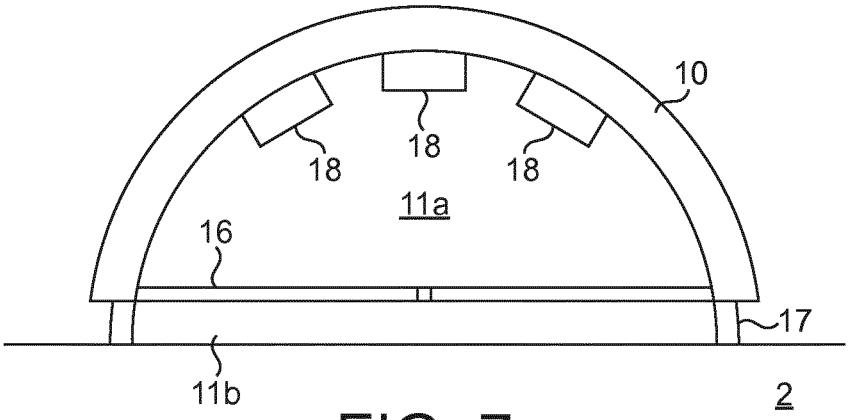
FIG. 7 is a schematic view of a cleaning apparatus according to a fifth embodiment of the present invention.
Figure 8:
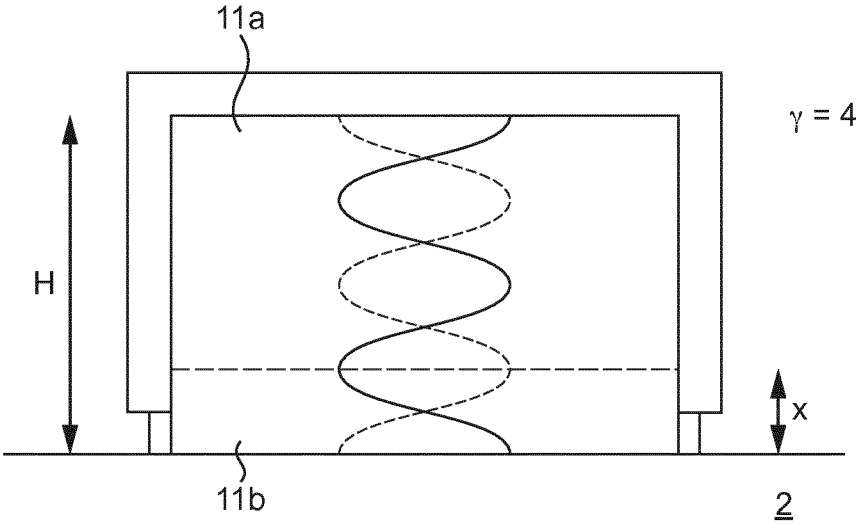
FIG. 8 is a schematic view of a $\gamma=4$ mode in an apparatus for cleaning a surface according to an embodiment of the present invention.

FIG. 7 illustrates another alternative embodiment, in which a cleaning apparatus comprises a hemispherical or dome-shaped body 10 and chamber 11*a*, 11*b*, and a plurality of acoustic transducers 18 forming an array arranged across a domed roof of the chamber such that acoustic energy generated by the acoustic transducers is, in use, focussed on the surface to be cleaned 2. In this embodiment, a membrane 16 similar to that described for the embodiment of FIG. 1 is provided in the dome-shaped chamber.

In one embodiment, the lateral width of the body 10 and chamber 11 (in a direction parallel to the surface to be cleaned) may be significantly greater than the length (in a direction perpendicular to the surface 2 to be cleaned) of the chamber 11. With such a width/length aspect ratio, the top wall 10*b* of the body 10 on which the acoustic transducer 18 is mounted (i.e. the top wall 10*b* of the body 10 facing and remote from the surface 2 to be cleaned) may function as an acoustic baffle that is substantially acoustically rigid for the transducer 18. The transducer 18 may be mounted on an outer face of the top wall 10*b*, remote from the chamber 11, or located within a closely-fitting hole provided in the top wall 10*b* so that the top wall 10*b* surrounds the transducer 18, thereby forming an acoustic baffle. When the distance between the transducer 18 and the surface 2 to be cleaned is small, additional cleaning may be induced by the contribution of the direct acoustic field from the transducer 18, which increases in amplitude close to the transducer 18 and superimposes upon the resonance mode in the chamber 11.

In various embodiments of the method of the present invention, the surface 2 to be cleaned is exposed to the atmosphere. The apparatus may be translationally slid over the surface 2 to be cleaned during at least the step in which the acoustic transducer 18 is used to introduce acoustic energy into the chamber 11 and the step in which the acoustic energy is passed through the divider 16 from the first portion 11*a* of the chamber 11 to the second portion 11*b* of the chamber 11, thereby generating pressure fluctuations at the surface 2 to be cleaned, to provide a continuous cleaning action over a surface area of the surface 2 which is larger than an area of the distal end 12 of the apparatus 1. The cleaning liquid engaging the surface 2 to be cleaned can act to lubricate a translationally sliding action of the distal end 12 over the surface 2 to be cleaned during at least these steps.

Alternatively, in other embodiments of the method of the present invention, the surface 2 to be cleaned is submerged in an underwater environment, optionally a ship hull, for example to clean biofouling from the exterior hull surface. Again, the apparatus may be translationally slid over the surface 2 to be cleaned during at least the step in which the acoustic transducer 18 is used to introduce acoustic energy into the chamber 11 and the step in which the acoustic energy is passed through the divider 16 from the first portion 11*a* of the chamber 11 to the second portion 11*b* of the chamber 11, thereby generating pressure fluctuations at the surface 2 to be cleaned, to provide a continuous cleaning action over a surface area of the surface 2 which is larger than an area of the distal end 12 of the apparatus 1. In these embodiments, water in the underwater environment and/or the cleaning liquid engaging the surface to be cleaned can act to lubricate a translationally sliding action of the distal end 12 over the surface 2 to be cleaned during at least these steps. Yet further, when the surface 2 to be cleaned is submerged in an underwater environment, the divider 16 can be omitted, and the chamber 11 is a single undivided chamber containing a cleaning liquid.

Various other modifications of the invention will be readily apparent to those skilled in the art, and are included within the scope of the invention as defined by the appended claims.

The invention claimed is:

1. An apparatus for cleaning a surface, the apparatus comprising:

a body defining a cavity, the body terminating in a distal end that is adapted, in use, to be in a vicinity of a surface to be cleaned such that the surface to be cleaned forms an end wall of a chamber including the cavity;

at least one cleaning liquid inlet for flow of a cleaning liquid into the chamber;

a divider located in or at an end of the cavity that divides the chamber into a first portion and a second portion, the second portion being in fluid communication with the surface to be cleaned;

an acoustic transducer associated with the first portion of the chamber to introduce acoustic energy into the chamber;

wherein the divider is adapted to permit passage of the acoustic energy therethrough from the first portion of the chamber to the second portion of the chamber to thereby allow pressure fluctuations to be generated at the surface to be cleaned; and a bubble generator adapted to generate or release bubbles into the cleaning liquid, such that the bubbles are driven towards the surface to be cleaned.

2. An apparatus according to claim 1, wherein the acoustic transducer is operable to generate acoustic resonance within the chamber when the apparatus is positioned on or adjacent to the surface to be cleaned with the surface to be cleaned forming an end wall of the chamber, an acoustic pressure antinode being formed at or adjacent to the surface to be cleaned.

3. An apparatus according to claim 1, wherein the divider comprises a membrane.

4. An apparatus according to claim 3, wherein the membrane is formed of a material that is substantially impedance matched to the cleaning liquid.

5. An apparatus according to claim 3, wherein the membrane is sufficiently thin that it does not substantially attenuate sound passing therethrough from the first portion of the chamber to the second portion of the chamber.

6. An apparatus according to claim 3, wherein the membrane is formed of a material with specific acoustic properties that match an acoustic field at its location.

7. An apparatus according to claim 1, wherein the divider comprises an interface between an acoustic energy transmitting material located in the first portion of the chamber, wherein the acoustic energy transmitting material comprises a different material to the cleaning liquid and has an acoustic impedance that is similar to an acoustic impedance of the cleaning liquid.

8. An apparatus according to claim 1, wherein the divider comprises an acoustic lens that focuses acoustic energy on the surface to be cleaned.

9. An apparatus according to claim 1, wherein the cleaning liquid inlet is arranged for flow of the cleaning liquid into the first portion of the chamber.

10. An apparatus according to claim 1, wherein the divider is adapted to allow cleaning liquid to flow therethrough from the first portion of the chamber into the second portion of the chamber, optionally wherein at least one hole, or a plurality of holes, is provided extending through the divider for allowing cleaning liquid to flow, from the first portion of the chamber into the second portion of the chamber, and further optionally wherein the plurality of holes is provided in a regular or irregular array.

11. An apparatus according to claim 1, wherein the cleaning liquid inlet is fluidically connected to the cavity at a location between the divider and the distal end of the body.

12. An apparatus according to claim 1, wherein the apparatus comprises a skirt arranged around the distal end of the body adapted to retain the cleaning liquid in the second portion of the chamber in contact with the surface to be cleaned or wherein the apparatus comprises a wet/dry vacuum device for removing excess cleaning liquid from the surface to be cleaned or wherein the apparatus comprises a cleaning liquid outlet for flow of the cleaning liquid out from the chamber.

13. An apparatus according to claim 1, wherein the apparatus comprises a liquid conditioning unit adapted to remove bubbles from the cleaning liquid supplied to the chamber.

14. An apparatus according to claim 13, wherein the apparatus comprises a first controller for the bubble generator which is adapted to control the bubble generator to generate or release pulses of bubbles.

15. An apparatus according to claim 1, wherein the apparatus comprises a second controller for the acoustic transducer which is adapted to control the acoustic transducer to generate pulses of acoustic energy.

16. An apparatus according to claim 1, wherein the apparatus comprises a first controller for the bubble generator which is adapted to control the bubble generator to generate or release pulses of bubbles and a second controller for the acoustic transducer which is adapted to control the acoustic transducer to generate pulses of acoustic energy, wherein the first and second controllers are coordinated so that pulses of bubbles and pulses of acoustic energy are generated with a mutually controlled time relationship.

17. An apparatus according to claim 1, wherein the acoustic transducer is adapted to be driven at a frequency in a range of 20 kHz to 10 MHz, or 20 kHz to 500 kHz, or 20 kHz to 200 kHz, or 20 kHz to 50 kHz or at least 50 kHz, or at least 60 kHz, or in a range from 60 to 140 kHz.

18. An apparatus according to claim 1, wherein the divider is configured or treated so as to reduce or avoid the divider acting to trap bubbles in the chamber, optionally wherein either or both of opposite surfaces of the divider is or are configured or treated so as to be hydrophilic.

19. A surface cleaning assembly including multiple apparatuses according to claim 1, wherein the multiple apparatuses are assembled together in a mutually adjacent or tessellated form to form a linear or two-dimensional array of a plurality of the bodies to form a linear or two-dimensional array of a plurality of a mutually adjacent or tessellated chambers, each chamber being associated with a respective acoustic transducer.

* * * * *